US010955120B2

(12) United States Patent
Wu et al.

(10) Patent No.: US 10,955,120 B2
(45) Date of Patent: Mar. 23, 2021

(54) LAMP HAVING RADIALLY DISPOSED LIGHT EMITTING MEMBERS THAT ROTATE ABOUT AN AXIS THAT IS NON-PARALLEL TO A TRANSMISSION AXIS

(71) Applicants: RADIANT OPTO-ELECTRONICS (SUZHOU) CO., LTD, Wujiang (CN); RADIANT OPTO-ELECTRONICS CORPORATION, Kaohsiung (TW)

(72) Inventors: Jui-Fang Wu, Kaohsiung (TW); Pin-Tsung Wang, Kaohsiung (TW); Pai-Ho Hsu, Kaohsiung (TW); Chih-Hung Ju, Kaohsiung (TW); Ming-Huang Yang, Kaohsiung (TW)

(73) Assignees: RADIANT OPTO-ELECTRONICS (SUZHOU) CO., LTD., Jiangsu (CN); RADIANT OPTO-ELECTRONICS CORPORATION, Kaohsiung (TW)

( * ) Notice: Subject to any disclaimer, the term of this patent is extended or adjusted under 35 U.S.C. 154(b) by 0 days.

(21) Appl. No.: 16/793,703

(22) Filed: Feb. 18, 2020

(65) Prior Publication Data

US 2020/0232630 A1 Jul. 23, 2020

Related U.S. Application Data

(63) Continuation of application No. PCT/CN2019/072764, filed on Jan. 23, 2019.

(51) Int. Cl.

| | |
|---|---|
| ***F21V 21/30*** | (2006.01) |
| ***F21V 21/15*** | (2006.01) |
| ***F21V 14/02*** | (2006.01) |

(52) U.S. Cl.

CPC ..... *F21V 21/30* (2013.01); *F21V 14/02* (2013.01); *F21V 21/15* (2013.01)

(58) Field of Classification Search

CPC ..... F21V 21/14; F21V 21/145; F21V 21/15; F21V 21/16; F21V 21/26; F21V 21/28; (Continued)

(56) References Cited

U.S. PATENT DOCUMENTS 5,335,154 A * 8/1994 Koitabashi ..... F21V 19/02 362/294
2007/0041194 A1* 2/2007 Chiu ..... F21V 21/30 362/286

FOREIGN PATENT DOCUMENTS

CN 102261613 A 11/2011
CN 202125815 U 1/2012
(Continued)

*Primary Examiner* — Robert J May
(74) *Attorney, Agent, or Firm* — Birch, Stewart, Kolasch & Birch, LLP

(57) ABSTRACT

A lamp has a base, a transmission mechanism, and multiple light-emitting assemblies. The transmission mechanism is mounted on the base and is rotatable around a transmission axis. The light-emitting assemblies is mounted on the base and is connected to the transmission mechanism. Each light-emitting assembly is rotatable around a rotation axis which is nonparallel with the transmission axis. The light-emitting assemblies can be rotated through driving the transmission mechanism, so as to adjust lighting effects of the light-emitting assemblies and an appearance of the lamp. Not only the lighting effects can be adjusted according to a user's need, but also the appearance of the lamp can be changed to adapt the lamp to the environment where the lamp is disposed, such that the lamp of the present invention can be widely used.

10 Claims, 10 Drawing Sheets

(58) Field of Classification Search
CPC ..... F21V 21/30; F21V 21/32; F21V 21/34; F21V 21/35; F21V 21/36; F21V 21/38; F21V 14/02
See application file for complete search history.

(56) References Cited

FOREIGN PATENT DOCUMENTS

| | | | |
|---|---|---|---|
| CN | 107747710 | A | 3/2018 |
| CN | 207849170 | U | 9/2018 |
| CN | 208090395 | U | 11/2018 |
| CN | 208237605 | U | 12/2018 |
| CN | 208397923 | U | 1/2019 |
| KR | 10-2011-0115017 | A | 10/2011 |
| TW | 435776 | | 5/2001 |
| TW | M470199 | U | 1/2014 |

* cited by examiner

LAMP HAVING RADIALLY DISPOSED LIGHT EMITTING MEMBERS THAT ROTATE ABOUT AN AXIS THAT IS NON-PARALLEL TO A TRANSMISSION AXIS

CROSS-REFERENCE TO RELATED APPLICATIONS

This application is a continuation application of international Application No. PCT/CN2019/072764 filed on Jan. 23, 2019, which is incorporated herein by reference.

BACKGROUND OF THE INVENTION

1. Field of the Invention

The present invention relates to a lamp, especially to a lamp capable of adjusting a light field and illuminance.

2. Description of the Prior Art(s)

Generally, lamps are used to provide ambient lighting. A conventional common lamp has a lamp holder, a light source, and a transparent cover. The light source is securely mounted in the lamp holder. The transparent cover covers the light source. When lighting with the lamp, a light-emitting angle of the light source of the lamp influences a light field and illuminance on surroundings, and different light fields and illuminance provide people with different visual effects and feelings.

As described above, in the conventional lamp nowadays, the light source is securely mounted in the lamp holder, such that it is unable to adjust an appearance and the light-emitting angle of the lamp. When users need different light effects for different activities, the conventional lamp is unable to meet the users' needs. Thus, there are many kinds of lamp fittings available for the users to buy on the market. The user is able to assemble different lamp fittings on the lamp according to the lighting effects that he needs, so as to allow the ambient lighting to meet the users' needs.

Although the users' needs for different lighting effects can be met by assembling said different lamp fittings on the lamp, it is inconvenient that the user has to repeatedly disassemble and assemble the lamp fittings whenever he has the needs for other lighting effects. Moreover, if multiple lighting effects are needed, multiple lamp fittings should be bought and prepared, which causes higher cost.

SUMMARY OF THE INVENTION

The main objective of the present invention is to provide a lamp having radially disposed light emitting members that rotate about an axis that is non-parallel to a transmission axis, so as to avoid the problem that multiple lamp fittings are necessary when intending to adjust a light field and illuminance, which is inconvenient and causes high cost.

To achieve the aforementioned objective, the lamp in accordance with the present invention comprises: a base; a transmission mechanism mounted on the base and being rotatable around a transmission axis; and at least one light-emitting assembly mounted on the base and connected to the transmission mechanism, each of the at least one light-emitting assembly being rotatable around a rotation axis, the rotation axis being nonparallel with the transmission axis and extending to intersect with the transmission axis, and the transmission mechanism being capable of driving the at least one light-emitting assembly to rotate to change a light-emitting angle of each of the at least one light-emitting assembly.

In a preferred embodiment of the present invention: the at least one light-emitting assembly is detachably connected with the transmission mechanism.

In a preferred embodiment of the present invention: each of the at least one light-emitting assembly includes a light-emitting module and a driven element, and the driven element is disposed on the light-emitting module and is connected to the transmission mechanism; the driven element of each of the at least one light-emitting assembly rotates around the rotation axis correspondingly and the rotation axis is perpendicular to the transmission axis; and the light-emitting module includes a light source and a light guide plate, the light source is connected to the driven element and is disposed radially relative to the transmission axis, and the light guide plate is connected to the light source and extends outward from the light source opposite to the driven element.

In a preferred embodiment of the present invention: the at least one light-emitting assembly of the lamp includes multiple light-emitting assemblies separately and annularly arranged.

In a preferred embodiment of the present invention: the base has multiple limiting slots formed in the base; the transmission mechanism includes a transmission element, a knob and multiple positioning units, the transmission element and the knob are oppositely mounted on the base, and the positioning units are mounted through the limiting slots respectively and are connected to the knob and the transmission element; and the at least one light-emitting assembly is connected to the transmission element.

In a preferred embodiment of the present invention: the lamp comprises a motor connected to the transmission mechanism; and the lamp comprises a control device wirelessly transmitting control signals to the motor to selectively start or stop the motor.

The lamp of the present invention provides ambient lighting. When the lamp is in use, a user is able to drive the light-emitting assemblies to rotate through controlling the transmission mechanism, so as to change the light-emitting angles of the light-emitting assemblies and to adjust the light fields and illuminance. The user is able to adjust the lighting effects according to his own need, and does not have to buy additional lamp fittings. Thus, the lamp of the present invention can be conveniently operated and the cost of buying the lamp fittings can be saved.

Moreover, an appearance of the lamp can be changed by driving the at least one light-emitting assembly to rotate through the transmission mechanism to adapt the lamp to the environment where the lamp is disposed, such that the lamp of the present invention can be widely used.

DETAILED DESCRIPTION OF THE PREFERRED EMBODIMENTS

Figure 1:
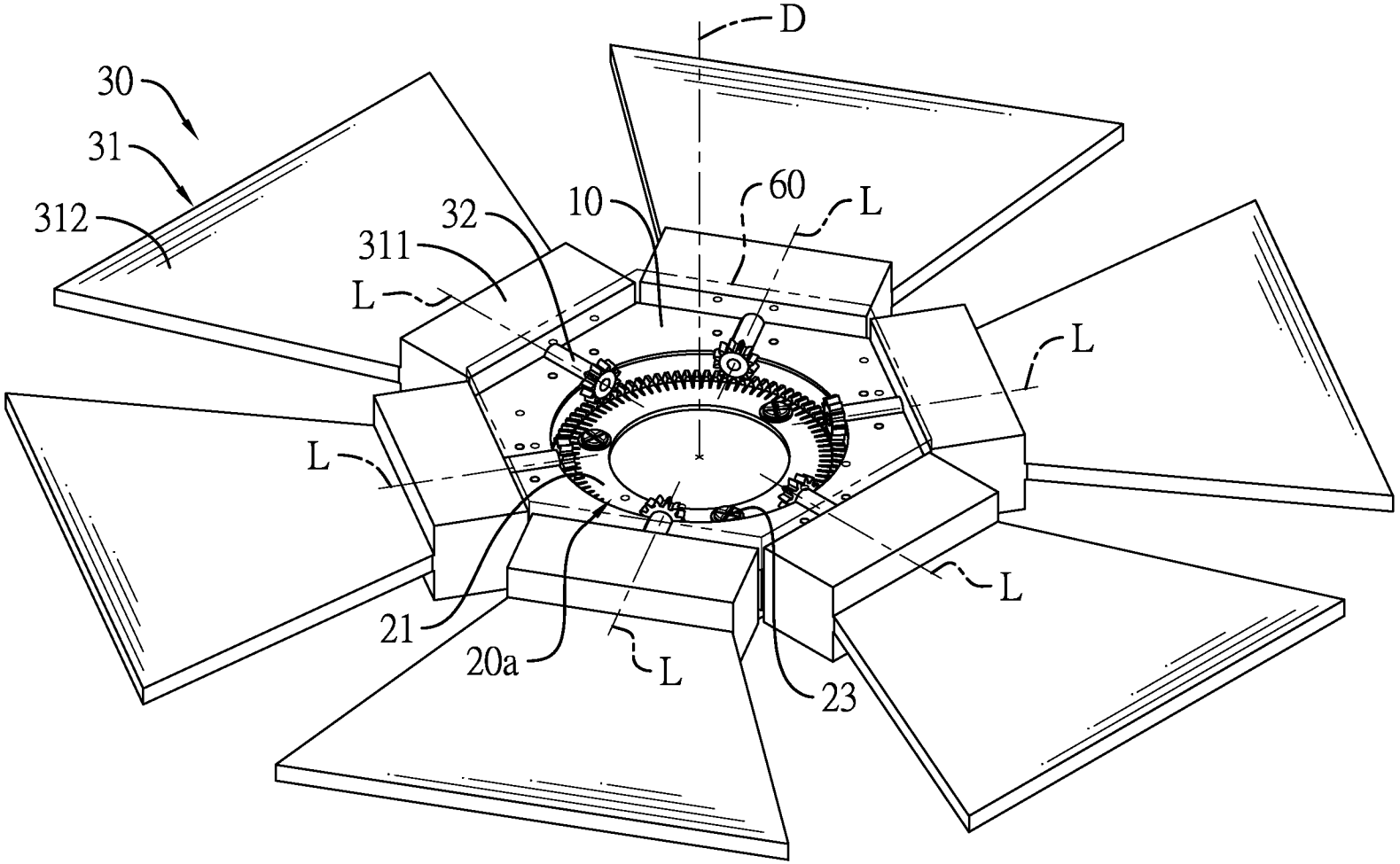
FIG. 1 is a perspective view of a first preferred embodiment of a lamp in accordance with the present invention.
Figure 2:
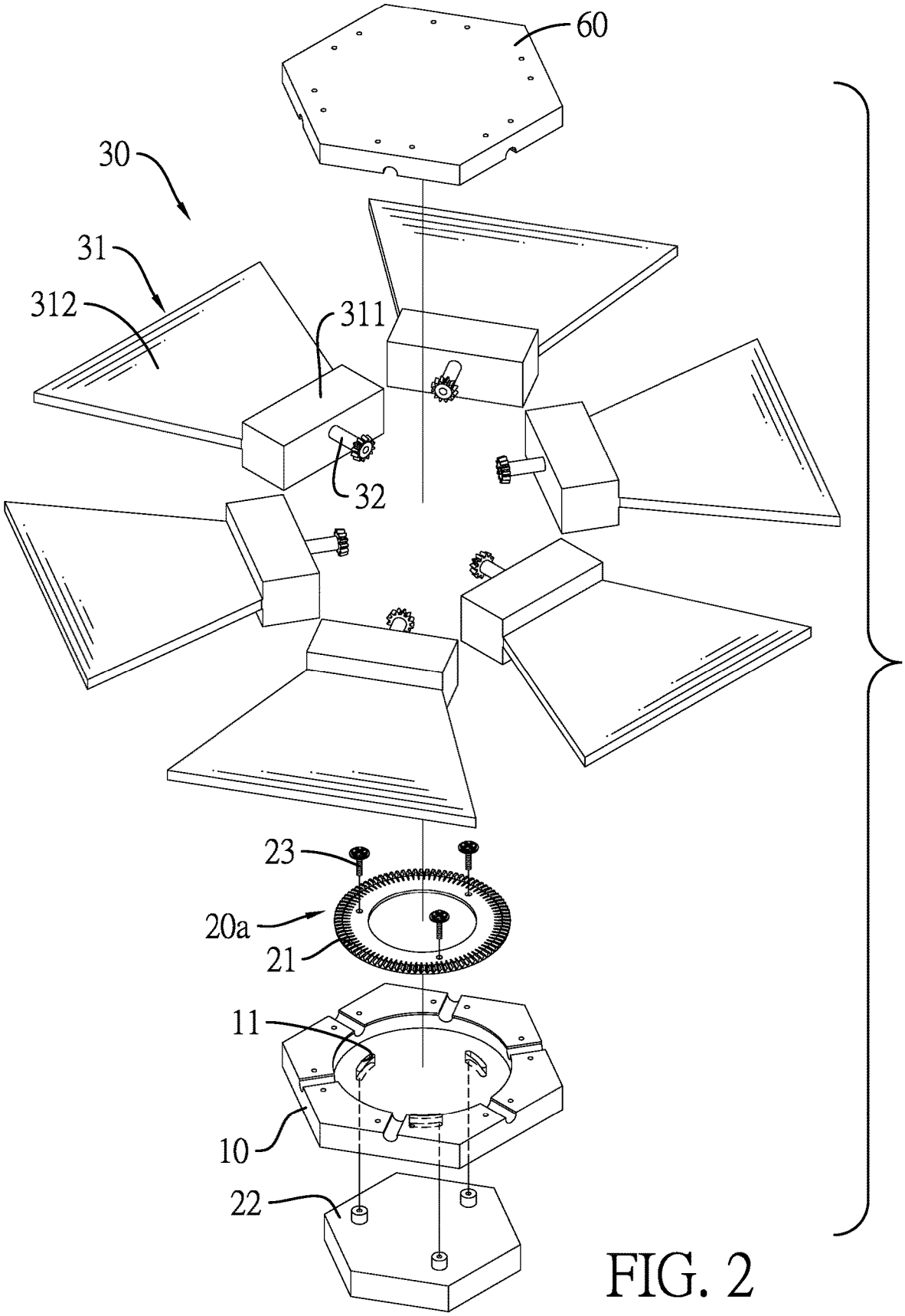
FIG. 2 is an exploded perspective view of the first preferred embodiment of the lamp in accordance with the present invention and an outer cap.
Figure 7:
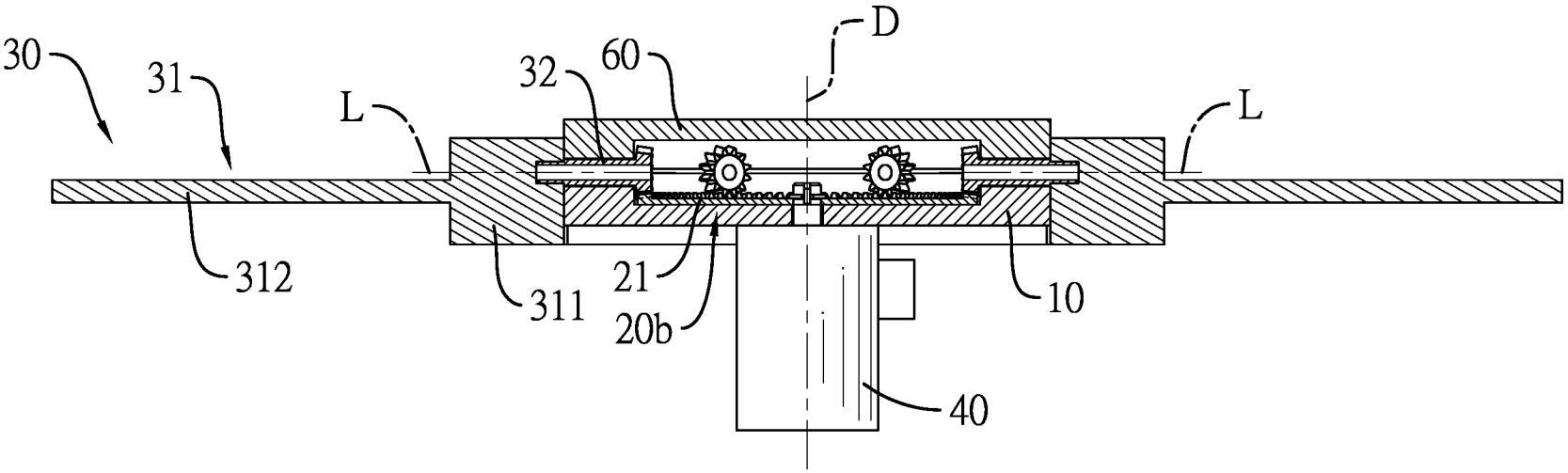
FIG. 7 a cross-sectional side view of a second preferred embodiment of a lamp in accordance with the present invention.

With reference to FIGS. 1, 2, and 7, several preferred embodiments of a lamp in accordance with the present invention are shown. The lamp comprises a base 10, a transmission mechanism 20*a*, 20*b*, and at least one light-emitting assembly 30.

Figure 4:
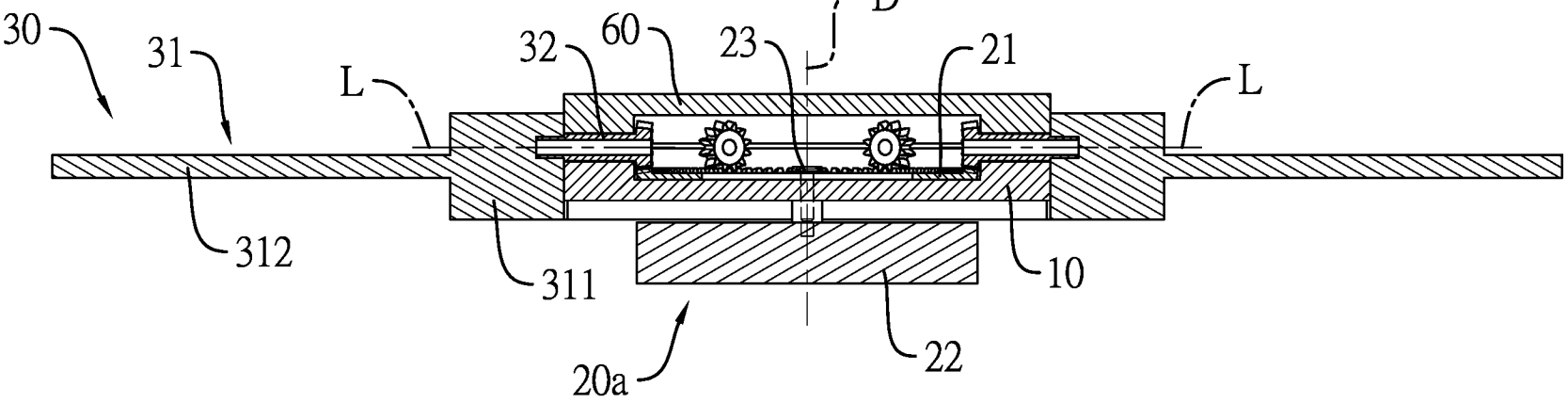
FIG. 4 is a cross-sectional side view of the first preferred embodiment of the lamp in accordance with the present invention.
Figure 5:
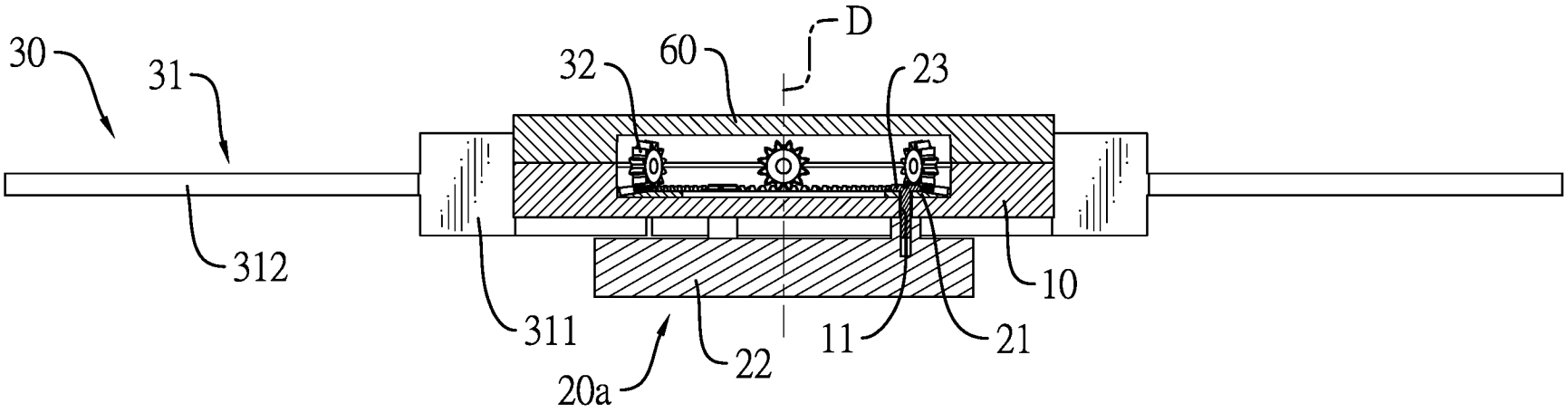
FIG. 5 is another cross-sectional side view of the first preferred embodiment of the lamp in accordance with the present invention.

As shown in FIGS. 1, 4, and 7, the transmission mechanism 20*a*, 20*b* is mounted on the base 10 and is rotatable around a transmission axis D.

Figure 9:
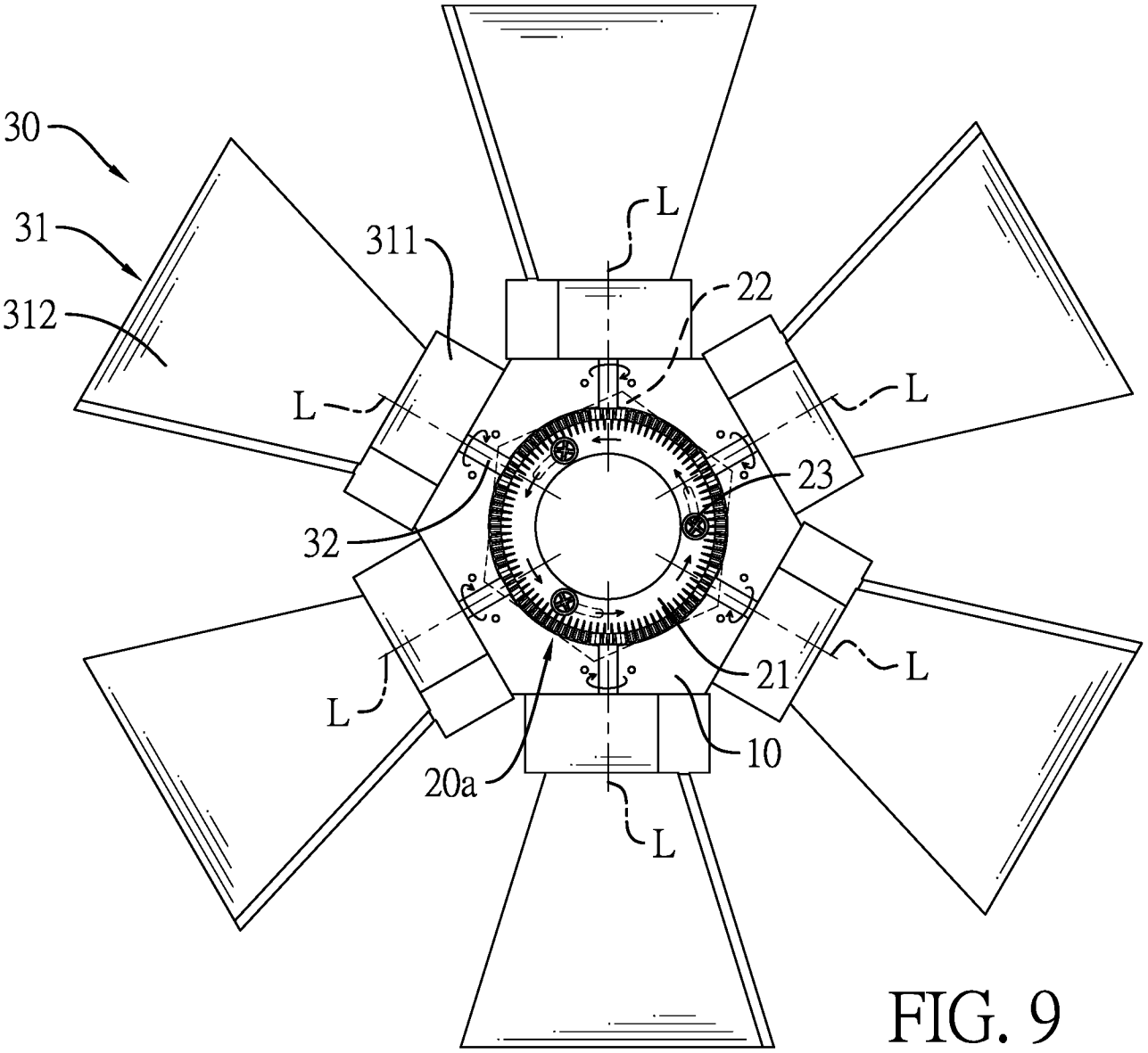
FIG. 9 is an operational top view of the first preferred embodiment of the lamp in accordance with the present invention.

As shown in FIGS. 1, 4, and 7, the at least one light-emitting assembly 30 is mounted on the base 10 and is connected to the transmission mechanism 20*a*, 20*b*. Each of the at least one light-emitting assembly 30 is rotatable around a rotation axis L. The rotation axis L is nonparallel with the transmission axis D and extends to intersect with the transmission axis D. In a preferred embodiment, the at least one light-emitting assembly 30 of the lamp includes multiple light-emitting assemblies 30 and the light-emitting assemblies 30 are separately and annularly arranged around the transmission axis D. The transmission mechanism 20*a*, 20*b* is capable of driving the at least one light-emitting assembly 30 to rotate to change a light-emitting angle of each of the at least one light-emitting assembly 30. Each of the at least one light-emitting assembly 30 rotates around the rotation axis L, and each of the at least one light-emitting assembly 30 further includes a light-emitting module 31 and a driven element 32. The driven element 32 is disposed on the light-emitting module 31 and is connected to the transmission mechanism 20*a*, 20*b*. Furthermore, as shown in FIG. 9, the at least one light-emitting assembly 30 is able to engage with or disengage from the transmission mechanism 20*a*, 20*b*.

As shown in FIGS. 4 and 7, the light-emitting module 31 includes a light source 311 and a light guide plate 312. The light source 311 is connected to the driven element 32 and is disposed radially relative to the transmission axis D. The light guide plate 312 is connected to the light source 311 and extends outward from the light source 311 opposite to the driven element 32. In the light-emitting module 31, the light guide plate 312 distributes light coming from the light source 311 to emit out of an upper face, a lower face, or a peripheral edge of the light guide plate 312 for the purpose of illumination. Moreover, as shown in FIGS. 4 and 7, the driven element 32 rotates around the rotation axis L correspondingly and the rotation axis L is perpendicular to the transmission axis D.

According to ways of driving the light-emitting assemblies 30, the transmission mechanism 20*a*, 20*b* of the lamp of the present invention is distinguished into two embodiments. Each of the embodiments are described as follows.

As shown in FIGS. 3 to 6, in the first preferred embodiment of the lamp of the present invention, the base 10 further has multiple limiting slots 11 formed in the base 10. The transmission mechanism 20 includes a transmission element 21, a knob 22, and multiple positioning units 23. The transmission element 21 and the knob 22 are oppositely mounted on the base 10. The positioning units 23 are mounted through the limiting slots 11 respectively, and are connected to the knob 22 and the transmission element 21. The light-emitting assemblies 30 are connected to the transmission element 21. More specifically, since the light-emitting assemblies 30 are separately and annularly arranged, the driven elements 32 of the light-emitting assemblies 30 are also separately and annularly arranged and are connected to the transmission element 21. A user is able to drive the transmission element 21 by turning the knob 22, so as allow the transmission element 21 to drive the light guide plates 312 of the light-emitting assemblies 30 to rotate around the rotation axes of themselves.

Figure 8:
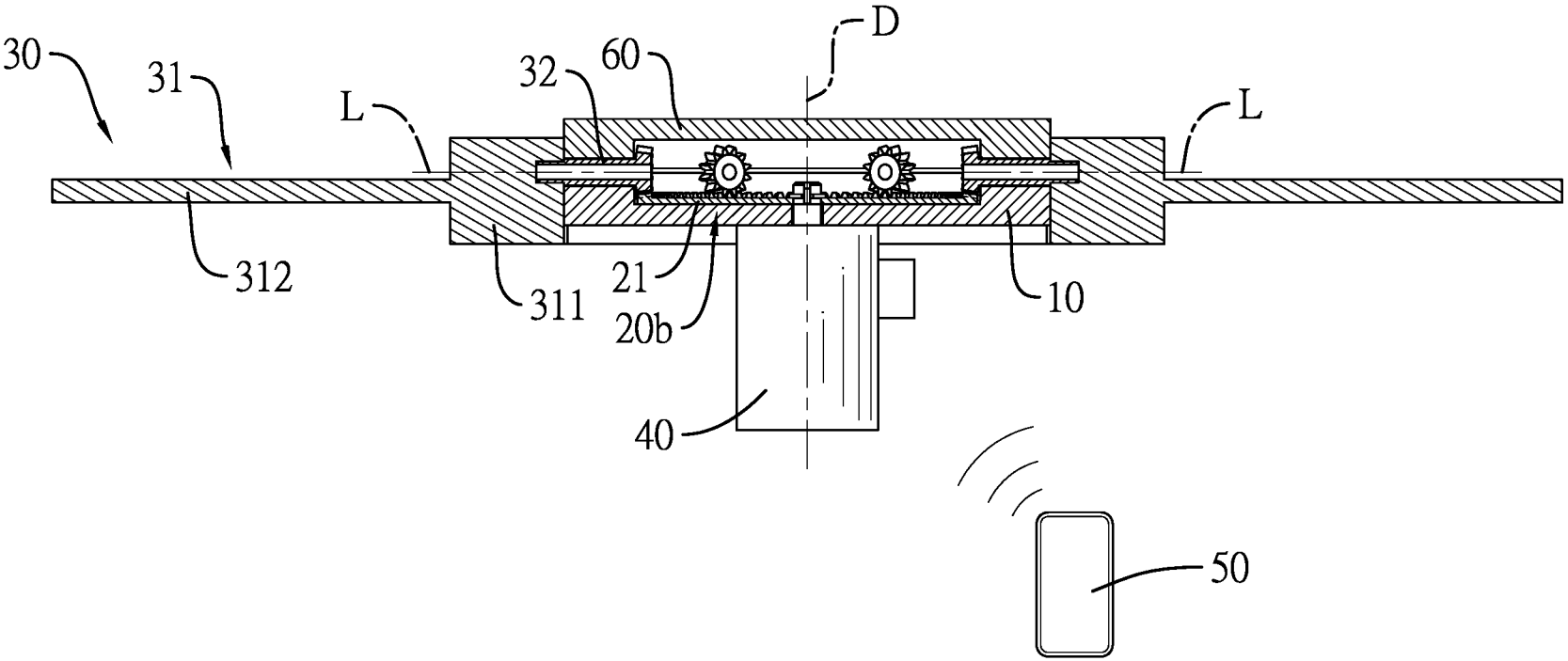
FIG. 8 a cross-sectional side view of a second preferred embodiment of the lamp in accordance with the present invention, showing controlling a motor with a control device.

As shown in FIGS. 7 and 8, in a second preferred embodiment of the lamp of the present invention, the lamp further comprises a motor 40. The motor 40 is connected to the transmission mechanism 20*b* which includes the transmission element 21. The light-emitting assemblies 30 are connected to the transmission element 20*b*. By driving the transmission element 21 with the motor 40, rotations of the driven elements 32 of the light-emitting assemblies 30 can be controlled and the light-emitting angles of the light-emitting assemblies 30 can be adjusted. Furthermore, the lamp is capable of further comprising a control device 50. The control device 50 wirelessly transmits control signals to the motor 40 to selectively start or stop the motor 40. More specifically, the control device 50 may be a smart phone, a tablet computer, or an Internet of Things (IoT) device. Thus, the user is able to remotely control the motor 40 of the lamp through the smart phone, so as to allow the transmission mechanism 20*b* to drive the light-emitting assemblies 30 to rotate.

In addition, in other embodiments, the transmission mechanism 20*b* may also further includes the multiple positioning units 23 and the knob 22. Thus, the user is able to manually control the rotations of the driven elements 32 of the light-emitting assemblies 30 by turning the knob 22, or electrically control the rotations of the driven elements 32 of the light-emitting assemblies 30 with the smart phone, the tablet computer or the IoT device, so as to adjust the light-emitting angles of the light-emitting assemblies 30.

Figure 3:
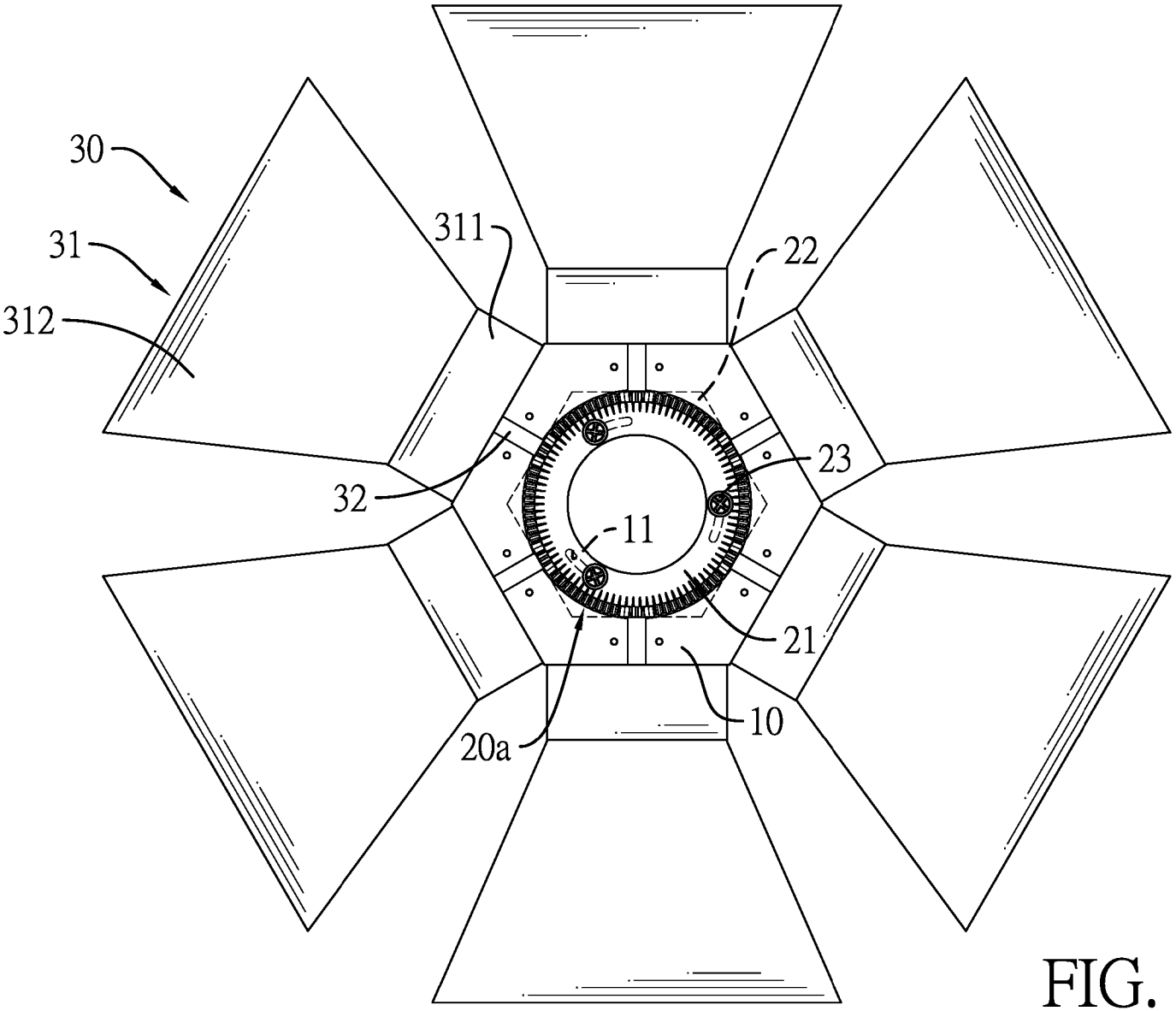
FIG. 3 is a top view of the first preferred embodiment of the lamp in accordance with the present invention.
Figure 10:
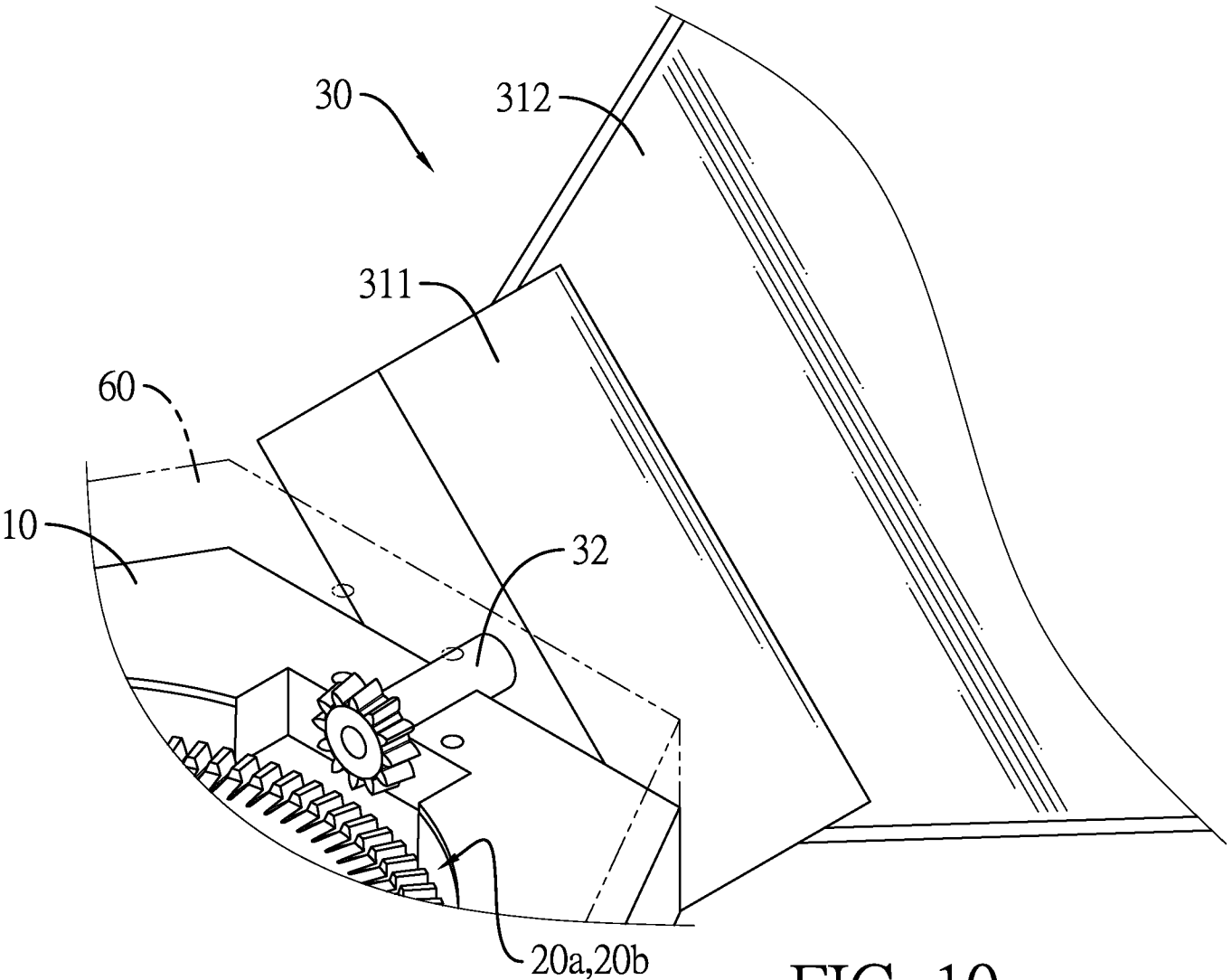
FIG. 10 is an operational enlarged perspective view of the lamp of the present invention, showing a light-emitting assembly and a transmission mechanism being detachable.

As shown in FIGS. 1, 3, and 10, the lamp of the present invention provides ambient lighting and further comprises an outer cover 60 covers the base 10. The outer cover 60 blocks dust and decorates the lamp to prevent the dust from accumulating on the transmission mechanism 20*a*, 20*b*, the transmission element 21 and the driven elements 32. The light sources 311 are connected to the driven elements 32 that are disposed in an interior defined by the base 10 and the outer cover 60. Opposite to the driven element 32, at least the light guide plates 312 are disposed outside the base 10 and the outer cover 60 for the purpose of illumination.

As shown in FIGS. 1, 3, and 9, when the lamp is in use, the user is able to drive the light-emitting assemblies 30 to rotate through controlling the transmission mechanism 20*a*, 20*b*, so as to change the light-emitting angles of the light-emitting assemblies 30 and to adjust light fields and illuminance.

Figure 6:
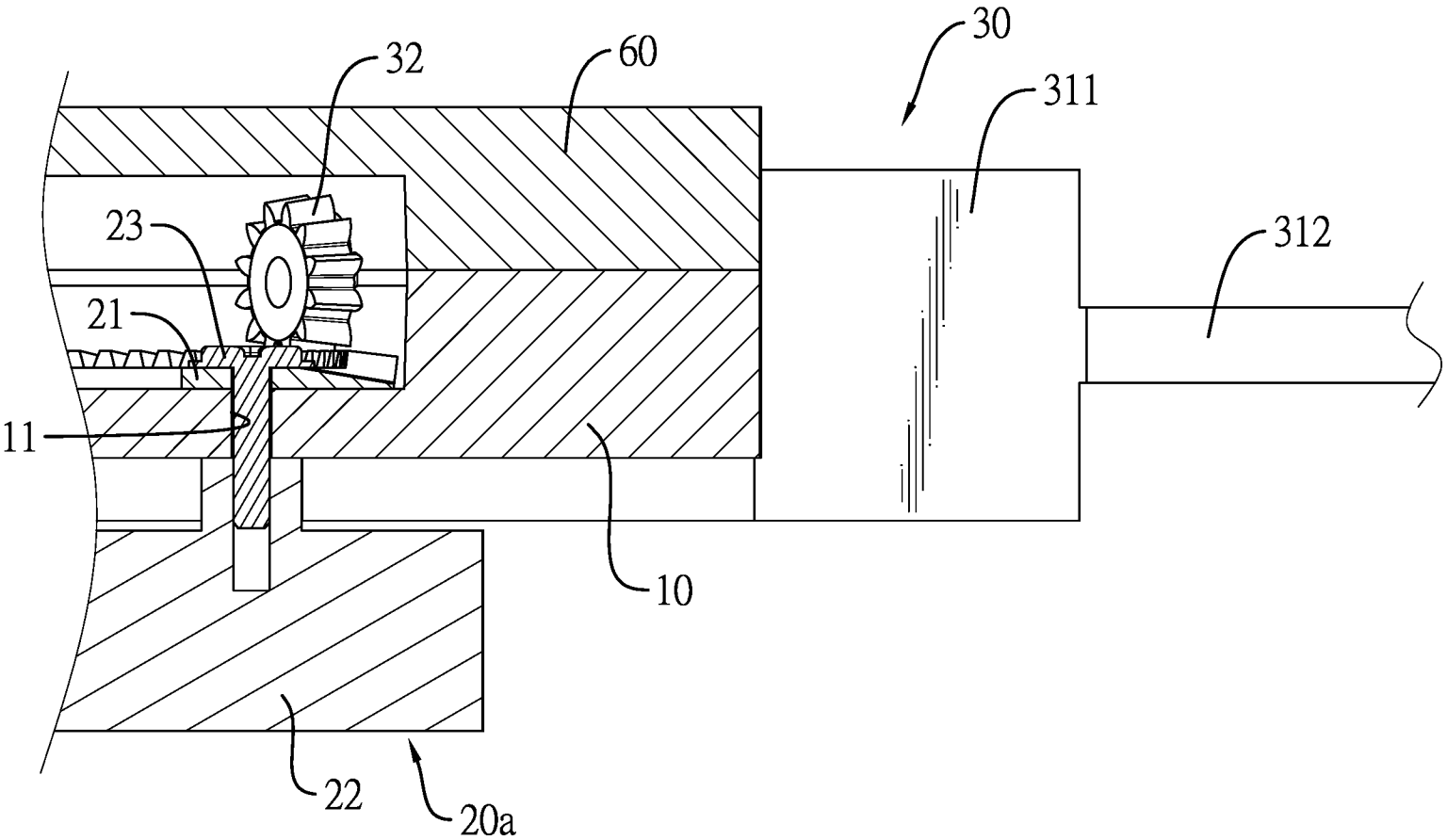
FIG. 6 is a partially enlarged view of FIG. 5.

As shown in FIGS. 3, 6, and 9, take the first preferred embodiment of the lamp of the present invention for example, when adjusting the lamp, the user turns the knob 22 to allow the knob 22 to drive the positioning units 23 and the transmission element 21 of the transmission mechanism 20*a* to simultaneously rotate around the transmission axis D. Meanwhile, the positioning units 23 moves in the limiting slots 11 respectively and the transmission element 21 drives each of the light-emitting assemblies 30 to rotate around the rotation axes L correspondingly. The limiting slots 11 limit rotation angles of the knob 22 and the transmission element 21, such that electric circuits do not damaged due to excessive rotation of the light-emitting assemblies 30.

In addition, as shown in FIGS. 7 and 8, take the second preferred embodiment of the lamp of the present invention for example, when adjusting the lamp, the user is able to control the motor 40 of the lamp and set a rotation angle of a rotating shaft of the motor 40 through the control device 50, so as to allow the transmission element 21 of the transmission mechanism 20 to drive the light-emitting assemblies 30 to respectively rotate around the corresponding rotation axes L to specific angles.

The light guide plates 312 of the light-emitting module 31 are disposed outside the base 10 and the outer cover 60. With the light guide plate 312 emits light from the opposite upper and lower surfaces and the peripheral edge, the ambient lighting is provided. Moreover, the light guide plates 312 may be made into different shapes according to the user's need. In addition to provide different lighting effects, an appearance of the lamp of the present invention can be more distinctive to adapt the lamp to different environments. Furthermore, as each of the light guide plates 312 are placed horizontally, by simultaneously rotating the driven elements 32 through the transmission element 21, rotation angles of the light guide plates 312 are ensured equal. Thus, the light fields in the ambient is uniform, the lamp is aesthetic overall, and uniformity of the ambient lighting is improved.

In addition, as shown in FIG. 10, since the at least one light-emitting assembly 30 is able to engage with or disengage from the transmission mechanism 20*a*, 20*b*, when the at least one light-emitting assembly includes multiple light-emitting assemblies 30 and the user intends to finely turn a specific one of the light-emitting assemblies 30, the user is able to detach the driven element 32 of said light-emitting assembly 30 from the transmission mechanism 20*a*, 20*b* by pulling said light-emitting assembly 30. Then by turning said light-emitting assembly 30 to a specific angle and pulling said light-emitting assembly 30 to allow the driven element 32 to connect with the transmission mechanism 20*a*, 20*b*, said specific light-emitting assembly 30 can be held at different angles. Accordingly, the lamp is able to show different light effects and appearances.

As described, in the lamp of the present invention, the light-emitting assemblies 30 is able to be rotated through the transmission mechanism 20*a*, 20*b*, so as to adjust the lighting effects of the light-emitting assemblies. 30 and the appearance of the lamp. Moreover, not only the lighting effects can be adjusted according to the user's need, but also the appearance of the lamp can be changed to adapt the lamp to the environment where the lamp is disposed, such that the lamp of the present invention can be widely used.

What is claimed is:

1. A lamp comprising:

a base;

a transmission mechanism mounted on the base and being rotatable around a transmission axis; and multiple light-emitting assemblies mounted on the base and connected to the transmission mechanism, each of the light-emitting assemblies being rotatable around a rotation axis that is perpendicular to the transmission axis, the rotation axis being nonparallel with the transmission axis and extending to intersect with the transmission axis, the transmission mechanism being capable of driving the light-emitting assemblies to rotate to change a light-emitting angle of each of the light-emitting assemblies, each of the light-emitting assemblies including a light-emitting module and a driven element, and the driven element disposed on the light-emitting module, connected to the transmission mechanism and rotating around the rotation axis correspondingly.

2. The lamp as claimed in claim 1, wherein the light-emitting assemblies is able to engage with or disengage from the transmission mechanism.

3. The lamp as claimed in claim 1, wherein the light-emitting module includes a light source and a light guide plate, the light source is connected to the driven element and is disposed radially relative to the transmission axis, and the light guide plate is connected to the light source and extends outward from the light source opposite to the driven element.

4. The lamp as claimed in claim 1, wherein the light-emitting assemblies are separately and annularly arranged, and the driven elements of the light-emitting assemblies are also separately and annularly arranged.

5. The lamp as claimed in claim 1, wherein the base has multiple limiting slots formed in the base, the transmission mechanism includes a transmission element, a knob and multiple positioning units, the transmission element and the knob are oppositely mounted on the base, the positioning units are mounted through the limiting slots respectively and are connected to the knob and the transmission element, and the light-emitting assemblies are connected to the transmission element.

6. The lamp as claimed in claim 4, wherein the base has multiple limiting slots formed in the base, the transmission mechanism includes a transmission element, a knob and multiple positioning units, the transmission element and the knob are oppositely mounted on the base, the positioning units are mounted through the limiting slots respectively and are connected to the knob and the transmission element, and the light-emitting assemblies are connected to the transmission element.

7. The lamp as claimed in claim 1, wherein the transmission mechanism includes a transmission element, the light-emitting assemblies are connected to the transmission element, and the lamp comprises a motor connected to the transmission element of the transmission mechanism.

8. The lamp as claimed in claim 4, wherein the transmission mechanism includes a transmission element, the light-emitting assemblies are connected to the transmission element, and the lamp comprises a motor connected to the transmission element of the transmission mechanism.

9. The lamp as claimed in claim 7, wherein the lamp comprises a control device, and the control device wirelessly transmits control signals to the motor to selectively start or stop the motor.

10. The lamp as claimed in claim 8, wherein the lamp comprises a control device, and the control device wirelessly transmits control signals to the motor to selectively start or stop the motor.

* * * * *